US006900505B2

(12) United States Patent
Chapple-Sokol et al.

(10) Patent No.: US 6,900,505 B2
(45) Date of Patent: May 31, 2005

(54) METHOD OF FORMING REFRACTORY METAL CONTACT IN AN OPENING, AND RESULTING STRUCTURE

(75) Inventors: Jonanthan D. Chapple-Sokol, Essex Junction, VT (US); Randy W. Mann, Jericho, VT (US); William J. Murphy, Essex Junction, VT (US); Jed H. Rankin, South Burlington, VT (US); Daniel S. Vanslette, Highgate Springs, VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/709,174

(22) Filed: Apr. 19, 2004

(65) Prior Publication Data

US 2004/0191562 A1 Sep. 30, 2004

Related U.S. Application Data

(62) Division of application No. 09/826,036, filed on Apr. 4, 2001, now Pat. No. 6,762,121.

(51) Int. Cl.[7] ..... H01L 31/119

(52) U.S. Cl. ..... 257/384; 257/388; 257/412; 257/413; 438/581; 438/682

(58) Field of Search ..... 257/413, 486, 257/384, 412, 456, 576, 754, 755, 770, 388; 438/580–583, 630, 647, 649, 651, 655, 656, 657, 664, 682, 683, 721, 755

(56) References Cited

U.S. PATENT DOCUMENTS

| | | | | |
|---|---|---|---|---|
| 5,804,499 | A | 9/1998 | Dehm et al. | |
| 5,863,170 | A | 1/1999 | Boitnott et al. | |
| 5,963,836 | A | 10/1999 | Kang et al. | |
| 6,074,443 | A | 6/2000 | Venkatesh et al. | |
| 6,281,118 | B1 | 8/2001 | Park | |
| 6,303,480 | B1 | 10/2001 | Desai et al. | |
| 6,524,952 | B1 * | 2/2003 | Srinivas et al. | 438/649 |

FOREIGN PATENT DOCUMENTS

| | | |
|---|---|---|
| WO | WO 99/00827 A1 | 1/1999 |

* cited by examiner

*Primary Examiner*—David Nelms
*Assistant Examiner*—Long Tran
(74) *Attorney, Agent, or Firm*—Connolly Bove Lodge & Hutz LLP; Larry J. Hume; William D. Sabo

(57) ABSTRACT

A structure which ensures against deterioration of an underlying silicide layer over which a refractory material layer is deposited by physical vapor deposition (PVD) or chemical vapor deposition (CVD) is realized by first providing a continuous polysilicon layer prior to the refractory material deposition. The continuous polysilicon layer, preferably no thicker than 50 Å, serves a sacrificial purpose and prevents damage to an underlying silicide layer by blocking interaction between any fluorine and the underlying silicide that is released when the refractory material is formed.

20 Claims, 2 Drawing Sheets

METHOD OF FORMING REFRACTORY METAL CONTACT IN AN OPENING, AND RESULTING STRUCTURE

CROSS REFERENCE TO RELATED APPLICATIONS

This Application is a Division of application Ser. No. 09/826,036 filed on Apr. 4, 2001 now U.S. Pat. No. 6,762,121, the entire contents of which are incorporated herein by reference.

BACKGROUND

This invention relates to a method of forming a refractory metal contact over a silicon substrate in a solid state structure, and to related structures. More particularly, the invention relates to a method employing a sacrificial silicon layer that serves as a nucleation layer for subsequent deposition of a refractory material to form a contact.

Conductive metal contacts are frequently found in semiconductor devices, and typically are formed by deposition of a refractory material, such as tungsten or the like, confined by a silicon oxide layer previously deposited over a conducting substrate containing, for example, a silicide. Steps in the conventional method of forming such contacts, and the nature of a problem that sometimes arises, are best understood with reference to FIGS. 1, 2, 3 and 4(A)–(B) hereof.

FIG. 1 is a cross-sectional view of a relevant portion of the underlying structure, wherein an underlying silicide layer 100 serves as a substrate 4 with an oxide layer 102 formed thereon. The location, shape and size of the desired conductor is determined by a through opening 104 formed in the oxide layer 102, with exposed surface 106 of the silicide serving as a bottom 106 of the opening 104. As best seen in FIG. 2, a thin metallic layer 200 is then deposited at the bottom of aperture 104 to serve as a contact liner. Then, per FIG. 3, a thin nucleation layer 300 of a refractory material such as tungsten is formed in the presence of silane gas to cover oxide layer 102, the sides 108 of aperture 104, per liner 200. This is followed, per FIG. 4(A), by the deposition of a layer 400 containing the desired refractory material in an amount sufficient to totally cover and fill up the inside of aperture 104 and to extend over the upper surface of oxide layer 102. Note that the nucleation layer 300 becomes, in effect, absorbed within the refractory layer 400.

Unfortunately, when a refractory material such as tungsten is deposited from decomposition of $WF_6$ through the use of either physical vapor deposition (PVD) or chemical vapor deposition (CVD), particularly during a chemical vapor deposition step, some of the fluorine released from decomposition of $WF_6$ combines with silicon in the silicide layer 100 and a propensity to form an undesirable region 402, as is probably best seen in the enlarged view in FIG. 4(B).

An example of a prior patent which appears to address a similar problem is U.S. Pat. No. 5,804,499, to Dehm et al., titled "Prevention of Abnormal $WSi_x$ Oxidation by In-Situ Amorphous Silicon Deposition", which suggests a process in which amorphous silicon is deposited in a thin layer on top of tungsten silicide to prevent abnormal $WSi_x$ oxidation during subsequent process steps. The layer of amorphous silicon as mentioned in this patent is bounded by a spacer also made of amorphous silicon. The reference does not teach the provision of a continuous layer of silicon to address the problem at issue.

The present invention seeks to address this particular problem in a simple and efficient manner.

BRIEF SUMMARY

This invention provides a method by which a refractory material may be deposited in and over an opening in a non-conducting layer over a conducting layer, employing a known PVD or CVD step, without damage to the underlying conducting layer.

The present invention also provides a structure which includes a refractory material contact formed over an opening in a non-conductive layer deposited over a conductive metal silicide layer.

Accordingly, in a first aspect of this invention, there is provided a method of filling an opening in an oxide layer, over a liner layer formed on a silicide layer underlying both the oxide layer and the liner layer, which includes the step of forming a continuous first layer of silicon on the oxide layer, a wall of the opening and the liner layer and, thereafter, forming a second layer of a refractory material on the first layer so as to cover the same and to also substantially fill the opening.

In another aspect of this invention, there is provided a multi-layer structure which includes a silicide layer having a first surface; an oxide layer formed on the first surface and having a second surface with a through opening defined in the oxide layer from the second surface to the first surface; a liner layer formed on the first surface at a bottom of the opening, a continuous silicon layer formed to extend over the second surface, the opening surface and the liner layer; and a refractory material layer formed on the silicon layer so as to substantially fill the opening.

These and other aspects, objectives and advantages of the present invention will become clearer from an understanding of the following detailed description with reference to the appended figures.

DESCRIPTION OF THE DRAWINGS

FIG. 1 is a cross-sectional view showing a metal silicide layer over which is formed a non-conducting oxide layer with a through aperture defined therein.

FIG. 2 is a cross-sectional view showing the structure per FIG. 1, with a metallic liner layer formed at a bottom surface of the aperture.

FIG. 3 is a cross-sectional view at a stage following FIG. 2, showing the deposition of a nucleation layer 300 of tungsten over the oxide layer, the sides of the opening formed therein, and the liner at the bottom of the opening.

FIG. 4(A) is a cross-sectional view at a later stage in the known process, wherein a deposit of a refractory material covers the oxide layer and fills the opening above the liner, and also indicates the presence of an undesirable region that may sometimes be formed during deposition of the refractory material due to interaction with the underlying silicide.

FIG. 4(B) is an enlarged view of a relevant portion of FIG. 4(A), to show more clearly the undesired contamination of the underlying silicide layer at the bottom of the opening that is otherwise filled with refractory material.

DETAILED DESCRIPTION

As indicated above, the present invention is aimed at providing a method that ensures against contamination of an underlying suicide substrate by any constituent of a refractory conducting layer during its deposition into the desired structure.

Figure 1:
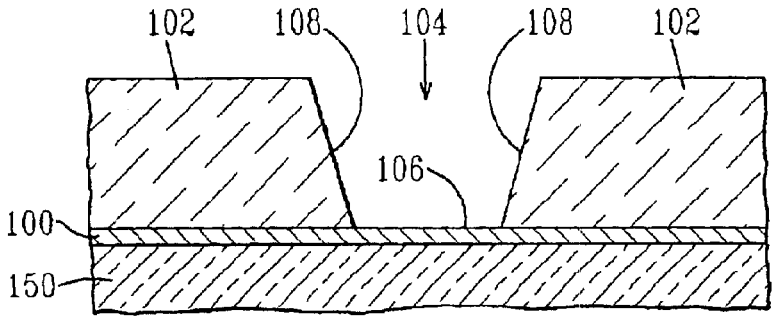
FIG.1 (Prior Art)
FIGS. 1, 2, 3 and 4(A)–(B) all relate to the prior art.
Figure 2:
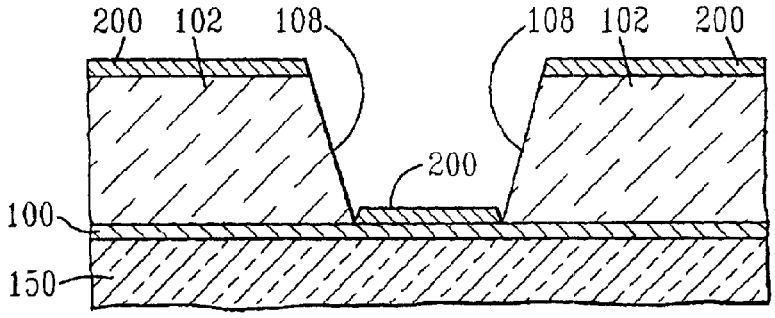
FIG.2 (Prior Art)

Referring to the structure illustrated in cross-sectional view in FIG. 2, note that a silicide layer 100, of the order of 300–800 Å in thickness and deposited on a silicon substrate 150, typically serves as a substrate for an oxide layer 102 deposited thereon with a through opening 104 defined therein, with a liner layer 200 deposited at the bottom 106 of opening 104 in known manner. Liner layer 200 may comprise at least one of titanium, titanium nitride, tungsten, and an alloy of titanium and tungsten, and may incidentally be deposited on the oxide layer 102. The preferred method according to this invention includes these steps of the prior art.

Figure 3:
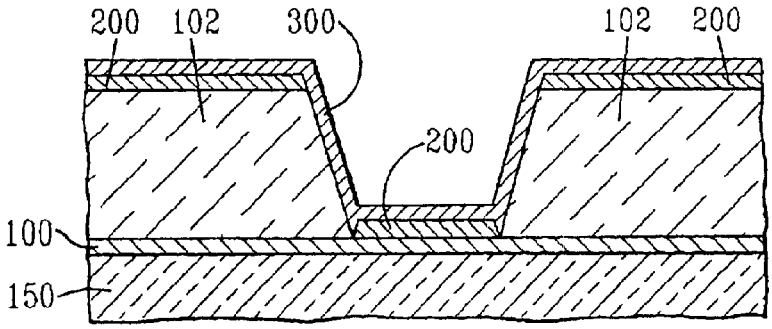
FIG.3 (Prior Art)
Figure 4A:
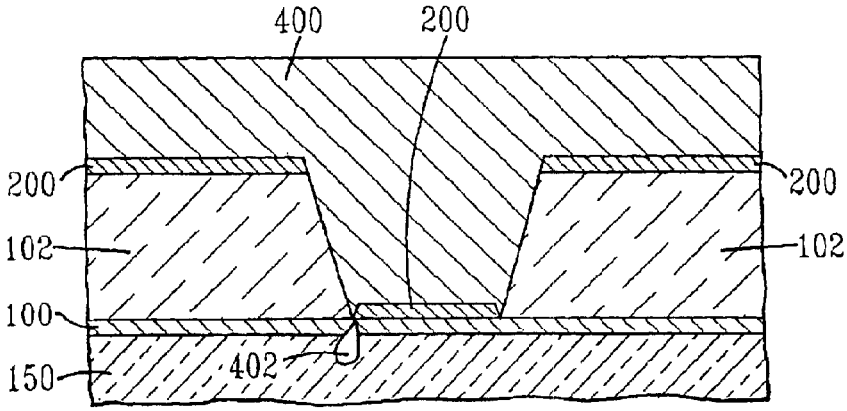
FIG.4A (Prior Art)
Figure 4B:
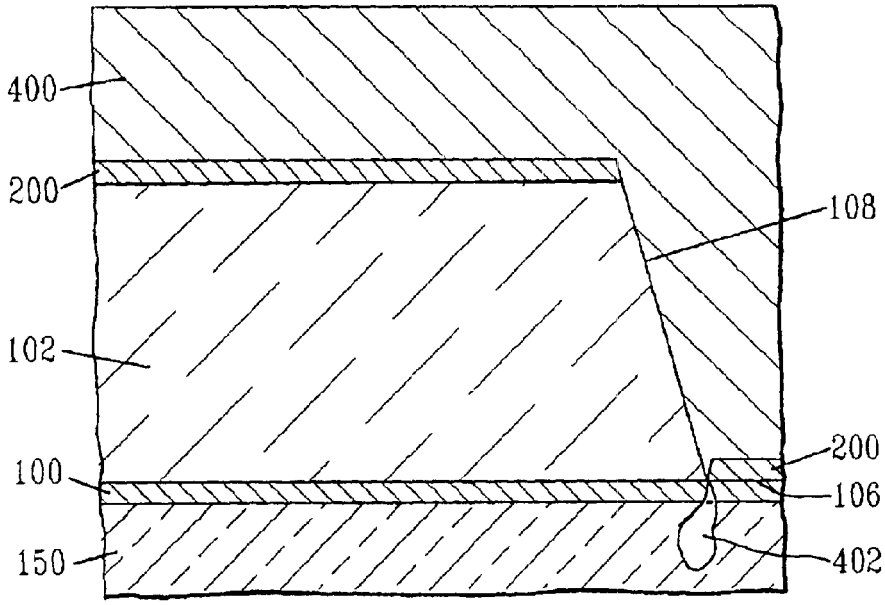
FIG.4B (Prior Art)

In the prior art, as best understood with reference to FIG. 3, a layer 300 of tungsten (W) deposited from $WF_6$ decomposition in the presence of silane was then formed as a nucleation layer.

Figure 5:
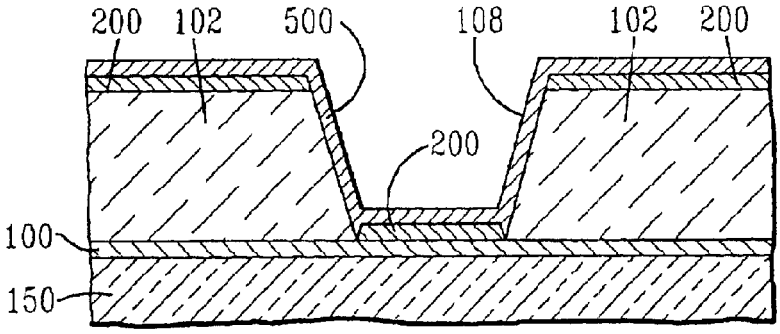
FIG. 5, per the method according to the present invention, is a cross-sectional view of the structure per FIG. 2 with the deposit of a continuous silicon layer over the oxide layer, the sides of the opening formed therein, and the underlying liner at the bottom of the opening.

According to the present invention, a continuous layer 500 of amorphous or polycrystalline silicon is deposited to a controlled thickness preferably by either physical vapor depositions (PVD) or by chemical vapor deposition (CVD), to extend over the oxide layer 102 and the upper surface of liner layer 200. This is best understood with reference to FIG. 5.

The continuous silicon layer 500 is intended to be a sacrificial layer, i.e., it is anticipated that it may chemically interact and combine with any fluorine (F) that becomes available when, for example, $WF_6$ is decomposed to generate a tungsten contact layer 400. In other words, it is intended in the present invention that some of this silicon be consumed in preference to any silicon from the underlying silicide layer 100. The deposited silicon layer 500 must be in the form of a continuous amorphous or polycrystalline silicon layer. The deposited polysilicon may be obtained by decomposition of a silane such as silane, disilane or trisilane. However, silanes containing ions such as dichlorosilane may advantageously be used and are preferred for this purpose.

Figure 6:
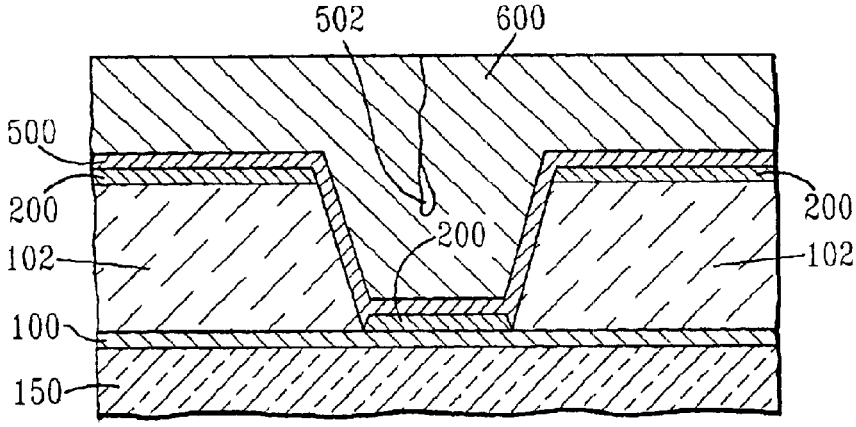
FIG. 6 is a cross-sectional view after deposition of a refractory material over the continuous silicon layer shown in FIG. 5.

The resulting structure is best understood with reference to FIG. 6, in which the silicide substrate 100 supports oxide layer 102 and liner 200, and the continuous sacrificial amorphous or polycrystalline silicon layer 500 formed thereon serves as a base for the refractory layer 600 which extends over oxide layer 102 and substantially fills the opening 104. Note that a small imperfectly filled region 502 may exist in the refractory material 600 within the volume of the substantially filled opening 104 without any deleterious effects on the resulting contact structure and its functionality.

The structure as illustrated in FIG. 6 can then be subjected to conventional subsequent processing such as planarization of 600, 500 and 200.

As previously indicated, the present invention is intended to provide a satisfactory refractory layer while avoiding the known problems associated with the related prior art. It is intended, further, that the "refractory material" may be a refractory metal, e.g., tungsten, titanium, tantalum or molybdenum employed directly as a "metal"; a refractory metal employed as a constituent of a "compound" thereof, e.g., titanium nitride, tantalum nitride, etc.; or even as a constituent of an "alloy" with another metal, e.g., titanium-tungsten. With any of these available options, the provision of a continuous silicon layer as discussed above ensures against the known problem.

It is intended that the desired refractory material layer 600 be formed in known manner by either a PVD or CVD process step.

It is preferred that the continuous sacrificial silicon layer 500 be provided as an amorphous or polysilicon film of a thickness not greater than about 50 Å.

The application of the continuous sacrificial silicon layer 500 by either the PVD or the CVD process is preferably accomplished at a temperature in the range 500°–650° C., with 600° C. being particularly preferred. It should be noted that when a PVD process is employed there may be little or no deposition of the silicon on sides 108, 108 of opening 104.

It should also be noted that the traditional way of providing a silicon deposition is to flow the silane gas in one process chamber over the underlying structure and, subsequent to depositing the desired silicon layer, to move the wafer supporting the desired structure into another process chamber where a $WF_6$ environment, for example, could be provided for the subsequent step of depositing tungsten thereon. An obvious problem in doing this is that the timing and conditions required to form the proper layer of silicon to protect the wafer from the chemically active $WF_6$ gas has a narrow process window and is subject to control problems.

The present invention, by utilizing the silicon layer as it does, i.e., as both a sacrificial layer and a nucleation layer, advantageously eliminates the need to do this. In other words, the wafer may be maintained in a single chamber and first be exposed to the silane or dichlorosilane to obtain the desired silicon layer under controlled conditions of time, temperature and flow rate, and this may be followed by passage of $WF_6$ gas over the same wafer in the same chamber under appropriate process conditions of controlled temperature, pressure and flow rate. The process is readily adaptable to either physical vapor deposition or chemical vapor deposition conducted in known manner. Any adaptation to employ any refractory metal, compound or alloy, may be made in known manner. It is considered that under all circumstances such as these, the sacrificial use of the continuous polysilicon film as taught in this invention ensures against deterioration of the underlying silicide layer.

It is considered that persons of ordinary skill in the art will consider obvious modifications of the present invention, both of the method and of the structure, and all such modifications are considered to be comprehended within the present invention which is limited solely by the claims appended below.

What is claimed is:

1. A multilayer structure, comprising:

a silicide layer having a first surface;

an oxide layer, on the first surface and having a second surface, with an opening through the oxide layer defined by an opening wall extending from the second surface to the first surface;

a liner layer on the first surface at a bottom of the opening;

silicon layer means extending over an entirety of the second surface, the opening surface, and the liner layer for preventing the silicide layer from interacting with any fluorine that may be present; and a refractory material layer on the continuous silicon layer means and substantially filling the opening.

2. The structure according to claim 1, wherein the silicon layer means comprises a continuous polysilicon layer that has a thickness not greater than about 50 Å.

3. The structure according to claim 1, wherein the silicon layer means comprises a continuous amorphous silicon layer that has a thickness not greater than about 50 Å.

4. The structure according to claim 1, wherein the refractory material layer comprises a metal selected from a group of refractory metals consisting of titanium, tantalum molybdenum and tungsten.

5. The structure according to claim 4, wherein the refractory material comprises the selected metal deposited as a metal, as a component of a nitride of the metal, or as a component of an alloy of the metal.

6. The structure according to claim 1, wherein the silicon layer means sacrificially protects the underlying liner layer and the silicide layer from any reaction with any fluorine that may be present.

7. The structure according to claim 1, wherein the silicon layer means comprises a nucleation layer for deposition of the refractory material layer thereon.

8. A multilayer structure obtainable by a method of filling an opening in an oxide layer over a liner layer formed on a surface of a silicide substrate underlying both the oxide layer and the liner layer, wherein the method comprises:

forming a first continuous sacrificial layer comprising silicon, by either physical vapor deposition (PVD) or chemical vapor deposition (CVD) at a first temperature in the range 500 C to 650 C completely covering the oxide layer and the liner layer;

forming a second layer, comprising a refractory material, on the first continuous sacrificial layer at a second temperature that is lower than the first temperature so as to cover the first layer and to also substantially fill the opening; and during said forming a second layer, sacrificing at least a portion of the first continuous sacrificial layer, wherein said sacrificing at least a portion of the first continuous sacrificial layer ensures against a deterioration of the silicide substrate underlying both the oxide layer and the liner layer.

9. The multilayer structure according to claim 8, wherein the first continuous sacrificial layer is a continuous layer of one of amorphous or polycrystalline that has a thickness not greater than about 50 Å.

10. The multilayer structure according to claim 8, wherein the first temperature is approximately 600 C.

11. The multilayer structure according to claim 8, wherein the refractory material contains a metal selected from a group of refractory metals consisting of titanium, tantalum, molybdenum and tungsten.

12. The multilayer structure according to claim 11, wherein the refractory material comprises one of the selected metals deposited as a metal, as a component of a nitride of the metal, or as a component of an alloy of the metal.

13. The multilayer structure according to claim 8, wherein the first continuous sacrificial layer sacrificially protects the underlying liner and the silicide substrate underlying both the oxide layer and the liner layer during the step of forming the second layer.

14. The multilayer structure according to claim 13, wherein the first continuous sacrificial layer serves as a nucleation layer for deposition of the second layer thereon.

15. The multilayer structure according to claim 8, wherein the first continuous sacrificial layer is formed by a chemical vapor deposition (CVD) process and extends continuously on the oxide layer, a wall of the opening and the liner layer.

16. The multilayer structure according to claim 8, wherein the liner layer comprises at least one of titanium, titanium nitride, tungsten, and an alloy of titanium and tungsten.

17. The multilayer structure according to claim 8, wherein said silicide substrate comprises a silicide layer on a silicon substrate.

18. The multilayer structure according to claim 8, wherein the second layer is formed from a fluorine containing compound.

19. The multilayer structure according to claim 18, wherein the fluorine containing compound comprises $WF_6$.

20. A multilayer structure, comprising:

a fluorine-free silicide layer having a first surface;

an oxide layer, on the first surface and having a second surface, with an opening through the oxide layer defined by an opening wall extending from the second surface to the first surface;

a liner layer on the first surface at a bottom of the opening;

a silicon layer containing fluorine extending over an entirety of the second surface, the opening surface, and the liner layer; and a refractory material layer on the silicon layer which substantially fills the opening, wherein the refractory material layer is obtained from a fluorine-containing compound.

* * * * *